United States Patent [19]

Gaspar

[11] Patent Number: 4,705,095

[45] Date of Patent: Nov. 10, 1987

[54] TEXTURED SUBSTRATE AND METHOD FOR THE DIRECT, CONTINUOUS CASTING OF METAL SHEET EXHIBITING IMPROVED UNIFORMITY

[75] Inventor: Thomas A. Gaspar, Columbus, Ohio

[73] Assignee: Ribbon Technology Corporation, Gahanna, Ohio

[21] Appl. No.: 817,514

[22] Filed: Jan. 9, 1986

[51] Int. Cl.[4] ..... B22D 11/06

[52] U.S. Cl. ..... 164/463; 164/479

[58] Field of Search ..... 164/423, 427, 429, 463, 164/479

[56] References Cited

U.S. PATENT DOCUMENTS

| | | | |
|---|---|---|---|
| 3,587,717 | 6/1971 | Yamauchi et al. | 164/429 |
| 3,908,745 | 8/1975 | Caldwell et al. | 164/423 |
| 4,212,343 | 7/1980 | Narasimhan | 164/429 |
| 4,489,772 | 12/1984 | McLane et al. | 164/463 |
| 4,552,199 | 11/1985 | Onoyama et al. | 164/423 |

FOREIGN PATENT DOCUMENTS

| | | | |
|---|---|---|---|
| 0147912 | 7/1985 | European Pat. Off. | 164/463 |

*Primary Examiner*—Nicholas P. Godici
*Assistant Examiner*—Richard K. Seidel
*Attorney, Agent, or Firm*—Frank H. Foster

[57] ABSTRACT

An improved heat extracting chill block roll and method for use in the continuous casting of ribbon-like metal sheet directly from the melt by means of rapid solidification techniques. The resulting product is considerably thicker and more uniform than previously possible by such techniques. A textured chill surface is formed on the roll by multi-sided protrusions having intermediate valleys between the protrusions. This provides a plurality of discontinuous surfaces on the sides of the protrusions. The preferred surface texture is that formed by a conventional knurling tool.

6 Claims, 8 Drawing Figures

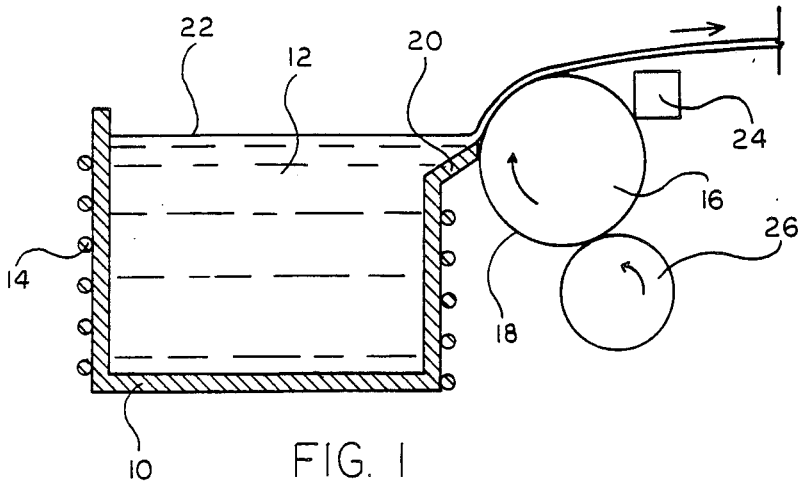
FIG. 1
FIG. 2A
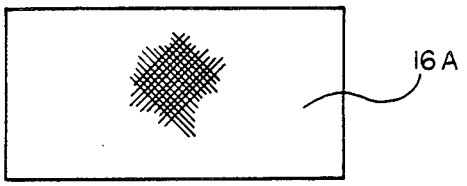
FIG. 2B
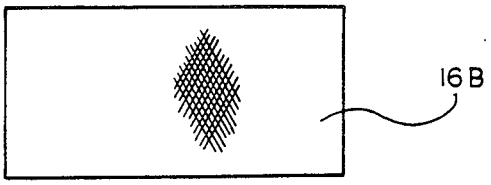

FIG. 3
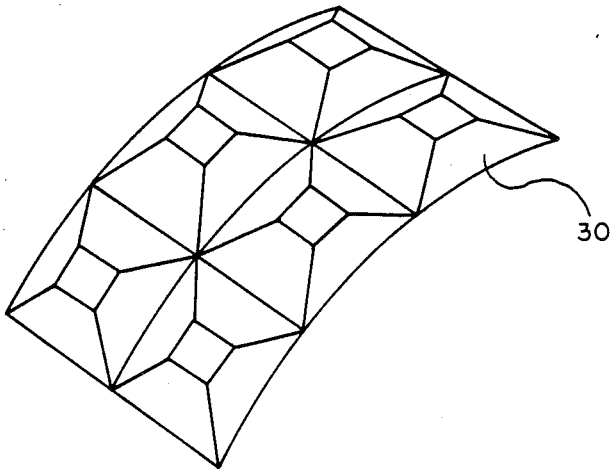
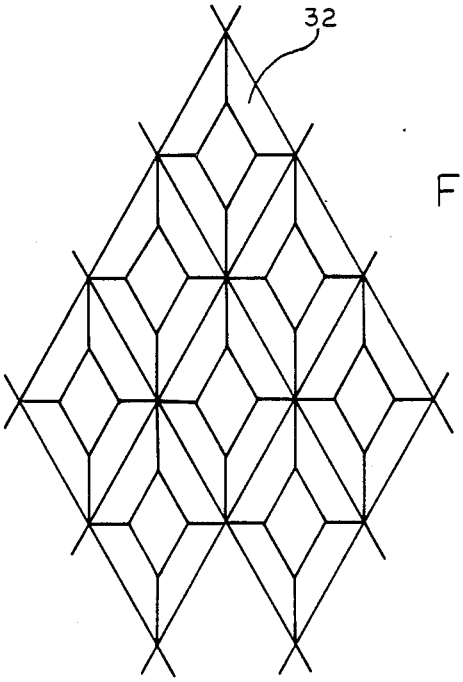
FIG. 4

| ALL KNURLED SURFACES | | DIAMOND |
|---|---|---|
| FINE KNURLS | 33 | PITCH |
| MEDIUM | 21 | " |
| COARSE | 14 | PITCH |

TEXTURED SUBSTRATE AND METHOD FOR THE DIRECT, CONTINUOUS CASTING OF METAL SHEET EXHIBITING IMPROVED UNIFORMITY

TECHNICAL FIELD

This invention relates generally to forming ribbon-like, metal sheet or strip and more particularly relates to improvements in the continuous casting of such metal sheet by direct casting of the molten metal upon a moving chill surface such as the peripheral outer surface of a rotating roll.

BACKGROUND ART

Molten metal has long been formed into useful shapes both by batch processing techniques in which the melt is poured into discrete molds and by continuous casting techniques.

Metal sheet or strip materials are conventionally prepared by casting a block of base metal in a mold and subjecting the block to progressively thinner rolling until it is as thin as desired. This is an expensive and extensive process requiring major capital investment in expensive machinery and further requiring considerable processing effort and energy.

Some types of continuous casting processes simulate batch casting by forming a continuous series of molds which travel past a source of melt and are continuously fed and filled with melt. As the filled molds progress along a line of travel, the metal cools and solidifies in the conventional manner. The cast objects are thereafter removed from the molds. Such a system is illustrated by U.S. Pat. No. 3,587,717.

A similar continuous casting process is shown in U.S. Pat. No. 4,212,343. An elongated strip is formed by continuously pouring the melt against a mold surface which has surface contours or shapes which are replicated in the surface of the sheet to provide special imprints or other surface features.

Continuous casting by means of direct casting technology has been used commercially to form various products. In direct casting, the molten metal is applied against a moving chill block surface upon which it is solidified. It is then stripped from the surface. A variety of direct casting techniques have been disclosed in the prior art including melt spin or jet casting, melt extraction, planar flow casting, melt drag and pendant drop casting. More recently melt overflow casting has been explored.

In order to form the commercially successful wire products of the prior art by direct casting, a disk, or alternatively a cylinder having circular or helical ridges simulating a plurality of side by side disks, is brought into contact with the melt at its outer periphery. The melt solidifies on the tips of the peripheral ridges and is then stripped away to form wire. Techniques of this type are illustrated in U.S. Pat. Nos. 3,838,185 and 3,871,439.

The wire making concepts of direct casting have been extended to produce flakes of metal by forming the surface of a rotating chill block into a series of islands or "lands" which extend outwardly from the rotating chill block surface. In making flakes, only the top surfaces of these islands are inserted into the melt. The melt chills and solidifies only upon these islands in order to form the discontinuous, discrete flakes. This technique is represented by U.S. Pat. No. 4,154,284.

The prior art has further suggested that elongated ribbons or strips of sheet material may be formed by applying a molten material to the exterior, smooth surface of a slowly rotating roll. Systems for accomplishing this are illustrated in U.S. Pat. Nos. 105,112; 905,758; and 993,904.

The prior art attempts to form ribbon-like, sheet material using direct casting have met with some difficulty. First, the strip product which has been formed has been too thin for significant commercial use and its thickness has been too difficult to control. This is because the melt which does solidify on the rotating roll only solidifies in a very thin layer on the order of two to five thousandths of an inch thick. There is a need for a system which permits reliably accurate control of the product thickness and permits production of a considerably thicker product with the economies of direct casting. A thicker product can be passed through a simple rolling operation to provide metal strip of a commercially acceptable uniformity and thickness.

Another problem with sheet materials formed in the past by direct casting techniques is that the sheet products have both a nonuniform thickness as well as nonuniform physical and chemical properties along and across the strip. I theorize that this occurs because the solidfying melt does not contact the rotating surface of the chilling substrate in a uniform manner. Instead, I believe that relatively large air pockets collect and form at random regions between the solidifying melt and the surface of the rotating, chill block substrate. The metal at these regions is in contact with the roll surface and therefore the rate of heat transfer to the roll is relatively smaller in those regions relative to the rate of heat transfer at other regions where there is good contact. The result of the difference in heat transfer rate is not only thinner regions but also regions of different physical properties and even different chemical composition. These regions are distributed in an uneven, nonuniform manner along the strip.

Yet another problem which arises from these uneven, large areas of noncontact between the metal and the chill surface is that these large, noncontacting regions will not be quenched sufficiently fast. Because of the speed at which the solidifying layer travels through the process, the strip will be removed while the solidifying metal is still at a temperature which is so high that the metal in these regions is still brittle. The result is that the strip will exhibit breaks, cracks, porosity and other defects.

In summary, the resulting products of the prior art tend to be insufficiently thick, their thickness is difficult to control and they exhibit a nonuniform thickness and a nonuniform distribution of physical and chemical properties.

BRIEF DISCLOSURE OF INVENTION

In the present invention the problems of uncontrollable and insufficient thickness and nonuniform properties are overcome by forming a textured surface upon the substrate surface or roll. The texture is not formed as a forming surface but rather as a rough surface. This causes the melt to form a thicker, more uniform sheet material across the textured surface and enables the thickness to be more accurately controlled. The textured surface is formed by multi-sided protrusions having interconnected valleys between the protrusions to provide a plurality of discontinuous surfaces on the sides of the protrusions which face obliquely toward the direction of travel of the roll surface. Preferably, the texture is constructed utilizing conventional knurling techniques.

An advantage of the present invention is that the resulting ribbon-like sheet material is both thicker and is more uniform both in dimensions and in chemical and physical properties. In addition, its thickness can be more consistently controlled. I hypothesize that this is because the textured surface imparts energy into the surface layer of the melt to improve dynamic wetting, provides increased surface area contact with the melt and provides increased frictional drag against the melt. The result is both more melt being pulled from the source of molten metal and also a heat transfer rate which is both more uniform and greater. The interconnected valleys between the protrusions are believed to provide a place for entrained air, which surrounds the rotating chill block roll surface, to be compressed and to flow with a more even distribution. The melt is therefore able to contact substantially all of the protrusions and bridges between them, thus making more uniform contact with the roll.

BRIEF DESCRIPTION OF DRAWINGS

FIG. 1 is a diagrammatic view illustrating a casting apparatus for practicing the present invention.

FIGS. 2A and 2B are views in side elevation illustrating textured rolls for use in the apparatus of FIG. 1 and embodying the present invention.

FIGS. 3–5 are detailed views of a segment of the surface of various alternative rolls embodying the present invention, the surfaces of which form substrates upon which the liquid metal solidifies.

Figure 5:
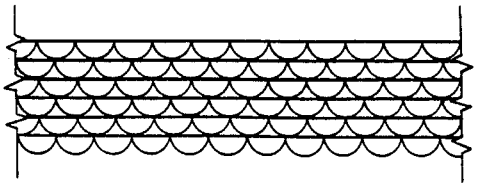

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 diagrammatically illustrates a preferred embodiment of the invention utilizing continuous casting directly from molten metal by direct casting. This particular example uses melt overflow. A refractive receptacle 10, constructed for example of alumina, contains a molten metal 12 which is heated in the conventional manner by an induction heater having a surrounding induction coil 14 operated, for example, at 1000 Hz.

A rotating, copper, chill block is formed by a heat extracting roll 16 which is driven in rotation and is journalled in suitable bearings so that its outer peripheral surface 18 is spaced outwardly from a lip 20, as short a distance as practical. The preferred receptacle 10 has side walls which are higher than the upper surface 22 of the melt 12, except for the region of the lip 20. The upper edge of the lip 20 is below the upper surface of the melt 12. The lip 20 with its peripheral, upper edge below the upper surface of the melt has a width somewhat less than the length of the roll 16 so that all the melt which overflows the lip 20 will contact and be solidified upon the moving peripheral surface 18 of the rotating roll 16. The roll 16 rotates in the direction indicated so that its peripheral surface moves vertically upwardly at the edge of the upper surface 22 of the melt 12 positioned above the lip 20.

In experiments, I have positioned a wooden two by four 24 against the periphery 18 of the roll 16 in order to remove any loose material deposited upon the periphery 18. For the same purpose I also prefer to provide a steel wool wiping roll 26 which rotates in contact with the chill block roll 16 to aid in cooling and to remove foreign matter.

The casting of continuous ribbon-like metal sheet is very substantially enhanced by forming a textured surface upon the chill block roll 16. The texture is a plurality of multi-sided protrusions which have intermediate valleys between the protrusions to provide a plurality of discontinuous surfaces on the side of the protrusions. These surfaces face obliquely toward the direction of travel of the periphery 18 of the roll 16.

Although suitable protrusions embodying the principles of the present invention may be formed in a random but uniform or homogeneous manner about the periphery of the chill block roll 16, a regular pattern is preferred and is more easily machined into the surface of the roll 16. The protrusions are most conveniently formed by a conventional, coarse knurling tool which cuts two oppositely directed, intersecting helical slots about the roll. This forms pyramidal protrusions with the sides of the pyramids being formed by the walls of the helical slots which themselves face outwardly, obliquely to radii of the roll 16.

If the helical slots are spaced sufficiently far apart, frustopyramidal protrusions are formed which are simply pyramids with the top lopped off. It is preferred, in order to provide uniformity of the textured surface, that the protrusions be substantially contiguous, that is having no relatively large valleys between them. It is also preferred that the surfaces of the protrusions not be substantially elongated in any direction. Preferably, the dimensions of all surfaces of the protrusions are substantially the same order of magnitude with no major gaps or relatively large surfaces. Instead, it is desired that the protrusions be as uniform as is practical.

The dimensions of these protrusions need to be within a range which is essentially appropriate to the viscosity or surface energy of the particular metal which is being cast. If the protrusions are made too small, they loose their effectiveness and become no more effective than a prior art smooth surface chill block roll. Similarly, if the protrusions become too large, the casting process will form particles or flakes or other discontinuous pieces of metal rather than continuous sheet. Preferably the protrusions are sufficiently small that several of them occur within the width of the strip being cast. Thus, no protrusion extends entirely across the width of the roll or the width of the roll contact area with the melt.

Although the use of the textured roll in accordance with the present invention is illustrated in connection with one type of direct casting technology, it can also be used with others. For example, the roll may be lowered into the surface of the melt in the manner of the melt extraction technique for wire making. The roll may be contacted and immersed into the melt not only at its side and bottom but also at other positions around the roll.

FIGS. 2(*a*) and 2(*b*) illustrate, diagrammatically, side views of alternative embodiments of the chill block roll 16. Two spiral or helical grooves are illustrated. They may intersect perpendicularly as illustrated in FIG. 2(*a*) or may intersect to form diamond based pyramids or frustopyramids in the more conventional manner of forming conventional knurled surfaces. The American Society of Mechanical Engineers have an American National Standard on Knurling which is identified as ANSI/ASME B94.6-1984. It may be referred to for more details on the formation of knurled surfaces.

FIG. 3 illustrates, in very close up detail, protrusions, such as protrusion 30, of the type illustrated in FIG. 2(*a*). These are regular, square baesd frustopyramids. Similarly, FIG. 4 illustrates a top view of diamond based frustopyramids formed as regular protrusions, such as protrusion 32.

In practicing the present invention, the rotating chill block roll 16 is rotated in contact with the edge of the top surface of the molten metal 12, preferably at an angular velocity which provides a surface speed of at least 50 centimeters per second. The height of the melt above the lip 20, at which the rotating chill block roll 16 makes contact with the melt 12, is greater than the height of the protrusions. Thus, the protrusions extend below the surface 22 of the melt 12, a distance greater than the height of the protrusions.

If the protrusions do not extend sufficiently below the surface 22 of the melt 12 or if the velocity of the peripheral surface of the chill block roll 16 becomes too excessive, or if the peripheral surfaces are too large, the product will no longer be continuous as is desired. Sufficiently fast rotation or minimal contact with the melt will produce flake or particle product.

I am not sure wwhy a rotating chill block roll in accordance with the present invention produces a continuous, more uniform and thicker strip than produced by a conventional, smooth roll. I do, however, have a theory to explain this phenomenon.

The interconnected valleys around the protrusions are believed to provide a place for the boundary layer of air or other gas which surrounds the rotating chill block roll to escape. The air flows into these valleys and remains uniformly distributed within the valleys rather than randomly collecting as relatively large bubbles separating the melt from a smooth casting surface causing discontinuities and defects in dimensions and metalurgical properties. This not only enables a more uniform contact between the melt and the chill block but, additionally, provides for more total contact area between them. As a result, not only is the heat transfer from the melt to the chill block roll more uniform, resulting in more uniform dimensions and metallurgical properties, but, in addition, a greater heat flow rate occurs, thus producing a thicker more useful metal strip.

Additionally, because of the greater surface contact and because the protrusions are able to pierce into or through the surface layer of the melt, the viscous drag and friction between the surface of the melt and the rotating roll is greatly increased.

This increase in viscous drag and friction causes the process to become more dependent upon the ability of the protrusions to drag melt from the pool and less dependent upon the physical properties of the particular metal being cast, such as its viscosity or surface tension. As a result, the entire process becomes more dependent upon, and in fact dominated by, the viscous drag and friction between the casting surface and the melt and considerably less dependent upon the physical properties of the particular alloy being cast. Thus, variations in alloys and their properties, such as variations in surface tension, cause considerably less variation in resulting products.

In summary, the texturing seems to override the effect of the properties of the particular melt and the other process parameters. By so substantially increasing the viscous friction or drag between the surface of the rotating roll and the melt, these other properties and parameters become relatively insignificant.

Perhaps the protrusions are mechanically pounding upon the surface layer of the melt sufficiently to change the surface energy of the meniscus by the application of mechanical energy from the protrusion surfaces. This overcomes the surface tension forces to increase the effective wetting of the rotating roll by the melt. The dynamic wetting effect thus becomes more dominant in the process.

The relative dimensional factors described above are important in the forming of the protrusions in view of the above theory. If the valleys between the protrusions are too wide, the melt will not bridge properly between the protrusions and perforations or large holes will result. However, if the protrusions have flat surfaces which are too large, they will begin to respond in the same manner as occurs with the prior art smooth surface roll as described above to produce air pockets and resulting discontinuities in dimensions and metallurgical properties in the metal above the oversized flat surfaces.

FIG. 5 shows an alternative texture which is formed by a plurality of side by side indentations in the roll surface. Each indentation is approximately semicircular and is formed by applying the flat end of an end mill obliquely, that is non-radially, to the surface, The uncut, approximately triangular intermediate regions form the protrusions of the present invention.

Figure 6:
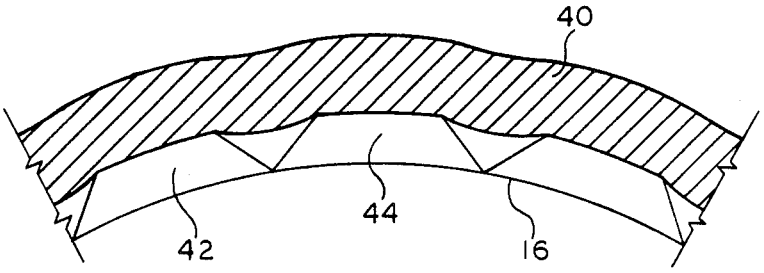
FIG. 6 is an end view illustrating the contact of the melt with the textured surface of the chill surface roll.

FIG. 6 is a view in cross section illustrating a small segment of melt 40 formed upon the surface of the chill block roll 16. The melt bridges between the protrusions 42 and 44. Some relatively minor pattern is observed in the product which is illustrated as the downward sag in the bridged areas between the protrusions. However, because the product is so thick it can be easily rolled to remove any such pattern if desired.

The result of producing metal strip in accordance with the present invention is the production of a thicker product which is dimensionally more uniform than heretofore possible by direct casting technology. Because the process is less dependent upon properties of the melt, the casting process is very stable and is easier to adjust in spite of the variations in casting parameters during processing resulting from the casting of different metals or other parameters variations, such as temperature. Since the product is not only thicker but is more uniform in dimensions when produced, it also is more uniform after being rolled when available with prior art techniques.

I have cast strips of copper, aluminum and carbon steel. Ordinarily it would be expected that the thickness of the resulting product would be substantially different for each metal because of their different properties. The copper would be expected to be thinner than aluminum because its thermal diffusivity is less than that of aluminum. Further, one would expect carbon steel to be extremely thin because it is a relatively poor thermal conductor, thus, permitting only a thin layer to chill upon the rotating roll before its surface rises above the upper surface of the melt. Instead, however, it was found that all three metals formed sheet of approximately 0.020 inches thick under approximately the same casting conditions.

Figure 7:
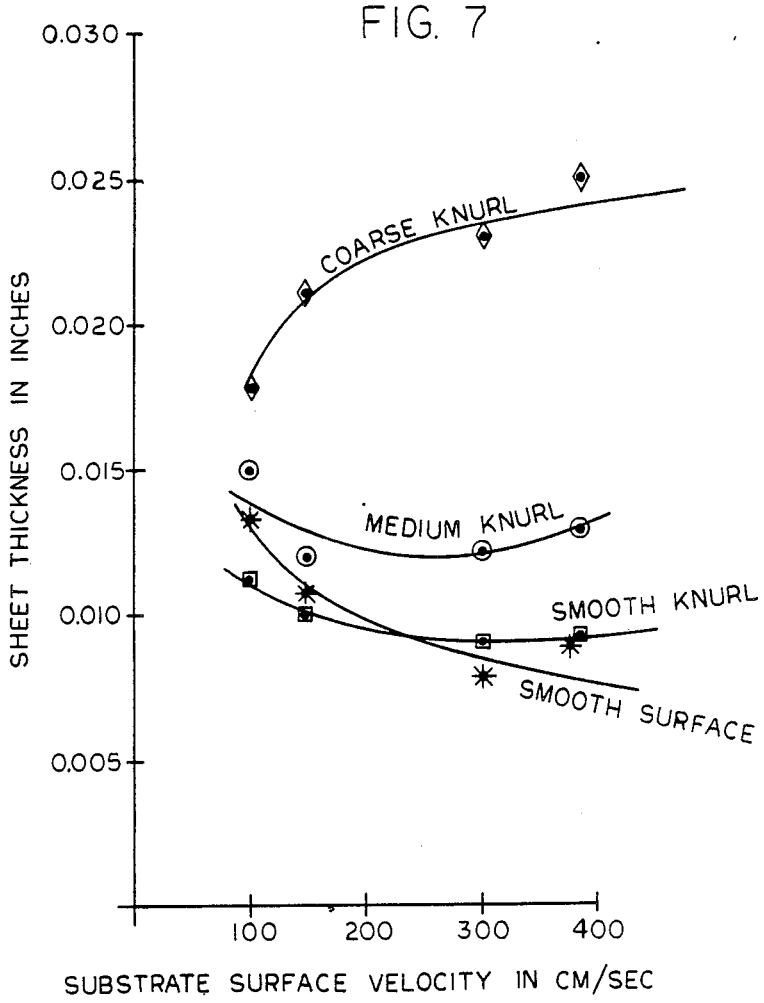
FIG. 7 is a graph depicting experimental results and illustrating the manner in which chill block roll speed can be used in the control of sheet thickness.

FIG. 7 is a graphical illustration of the results of experiments which were conducted. In these experiments, experimental cylindrical substrates or rolls having different surface textures were operated at differing speeds in accordance with the present invention. The thickness of the material produced at these different speeds was measured and plotted to form a family of curves, each curve representing the sheet thickness as a function of substrate surface velocity.

The smooth surface shows the characteristic that the material becomes thinner as speed is increased. However, for the knurled surfaces, contrary to predictions based on prior art principles, there were substantial regions at which the thickness of the material increased as the velocity of the substrate surface increased. In addition, while the thicknesses which were observed with the fine and medium knurl were similar to the thicknesses observed with the smooth wheel, the product thickness observed with the coarse knurl was considerably greater. Thus, it can be seen that material thickness is controllable by a combination of projection size choices and substrate surface velocity choices. Furthermore, a predictable family of curves is provided which permit the choices of operating conditions to be made with predictable reliability.

The curves appear to converge at a substrate surface velocity of approximately 50 cm/sec. Below this velocity, the advantagesof the present inventions are lost.

Of course, eventually as velocity increases material again becomes thinner and eventually it will become sufficiently thin as to become discontinuance. In addition, as the coarseness of the projection becomes increasingly greater, eventually it is theorized that discontinuities will occur so that flakes will begin to be produced.

While certain preferred embodiments of the present invention have been disclosed in detail, it is to be understood that various modificatons may be adopted without departing from the spirit of the invention or scope of the following claims.

I claim:

1. A method for forming ribbon-like metal sheet directly from molten metal by rotating the surface of a rotating, heat extracting substrate in contact with molten metal to solidify it upon the surface of the substrate, the method comprising:

(a) forming a friction enhancing textured chill surface upon a substrate, the chill surface having multisided protrusions with interconnected valleys between the protrusions to provide a plurality of discontinuous surfaces which face obliquely toward the direction of travel of the substrate surface; and (b) rotating the substrate upwardly across an edge of the upper surface of the molten metal at a surface velocity sufficiently fast to prevent complete chill surface replication and thereby causing the melt surface which interfaces the chill surface to bridge between the protrusions and leave a space into which boundary gas can escape and a depth below the surface of the molten metal greater than the height of the protrusions.

2. A method in accordance with claim 1 wherein the surfaces of the protrusions are formed substantially contiguous and are not substantially elongated in any direction.

3. A method in accordance with claim 2 wherein the dimensions of the surfaces of the protrusions are less than the width of the sheet being cast.

4. A method in accordance with claim 3 wherein said textured surface is rotated vertically upwardly at an edge of the upper surface of said molten metal.

5. A method in accordance with claim 1 wherein said rotating textured surface is lowered down into the surface of the melt.

6. A method in accordance with claim 1 wherein the melt is extruded onto said textured surface.

* * * * *